US008680717B2

(12) United States Patent
Morimoto et al.

(10) Patent No.: US 8,680,717 B2
(45) Date of Patent: Mar. 25, 2014

(54) RELAY CONTROLLER

(75) Inventors: Mitsuaki Morimoto, Susono (JP); Eiichiro Oishi, Susono (JP)

(73) Assignee: Yazaki Corporation, Tokyo (JP)

( * ) Notice: Subject to any disclaimer, the term of this patent is extended or adjusted under 35 U.S.C. 154(b) by 610 days.

(21) Appl. No.: 12/994,970

(22) PCT Filed: May 29, 2009

(86) PCT No.: PCT/JP2009/059884

§ 371 (c)(1),
(2), (4) Date: Nov. 29, 2010

(87) PCT Pub. No.: WO2009/145309

PCT Pub. Date: Dec. 3, 2009

(65) Prior Publication Data

US 2011/0109168 A1 May 12, 2011

(30) Foreign Application Priority Data

May 30, 2008 (JP) ..... 2008-143293

(51) Int. Cl.
*H01H 35/00* (2006.01)
*H01H 83/00* (2006.01)

(52) U.S. Cl.
USPC ..... 307/116

(58) Field of Classification Search
USPC ..... 307/10.1, 112, 116, 125, 132 E
See application file for complete search history.

(56) References Cited

U.S. PATENT DOCUMENTS 5,953,198 A 9/1999 Murata et al.

FOREIGN PATENT DOCUMENTS

| | | | |
|---|---|---|---|
| CN | 1173722 | A | 2/1998 |
| JP | 62-140330 | A | 6/1987 |
| JP | 3-28705 | U | 3/1991 |
| JP | 5-166444 | A | 7/1993 |
| JP | 2006-114446 | A | 4/2006 |
| JP | 2007-294226 | A | 11/2007 |

OTHER PUBLICATIONS

International Search Report, dated Sep. 1, 2009, issued in Application No. PCT/JP2009/059884.
Office Action, dated Jan. 18, 2013, issued by the State Intellectual Property Office of the People's Republic of China in counterpart Chinese Patent Application No. 200980119794.0.
Office Action dated Jul. 5, 2012, issued by the Japanese Patent Office in counterpart Japanese Application No. 2008-143293.

*Primary Examiner* — Carlos Amaya
(74) *Attorney, Agent, or Firm* — Sughrue Mion, PLLC

(57) ABSTRACT

Provided is a relay controller which can shorten the time from turning off a switching element until turning off a relay compared with what is conventionally possible. The relay controller comprises a relay switch in which a contact point connects a power supply to a load, and a coil is connected to the power supply; a first switching element which is connected in series to the coil; a regenerative current circuit which is connected in parallel to the coil and includes a second switching element and a diode which is connected in series to the second switching element; a first switching element control unit which turns on the relay switch by PWM control of the first switching element and turns off the relay switch by stopping the PWM control of the first switching element, and a second switching element control unit which turns on the second switching element when the first switching element is PWM-controlled and turns off the second switching element when the PWM control of the first switching element is stopped.

8 Claims, 4 Drawing Sheets

RELAY CONTROLLER

TECHNICAL FIELD

The present invention relates to a relay controller.

BACKGROUND ART

Patent Literature 1 describes a relay controller for controlling a relay. The relay controller described in Patent Literature 1 includes a resistor and a transistor which are connected in series to a coil of the relay and a diode which is connected in parallel to the resistor and the coil. The relay controller described in Patent Literature 1 applies the initial current to the coil of the relay to turn on the relay. Then, the relay controller described in Patent Literature 1 detects the current flowing through the coil of the relay by using the resistor, and performs PWM (Pulse Width Modulation) control of the transistor so that the detected value is kept at a value lower than the initial current and the relay is kept to be turned on. The PWM control indicates a control repeating to turn on and off a switching element (the transistor, here). On the contrary, a regenerative current flows through the diode. The regenerative current indicates a current which flows through the coil when the switching element is turned off.

Since the relay controller described in Patent Literature 1 can keep the value of the current flowing through the coil of the relay at a value lower than a value of the initial current, the power consumption of the coil of the relay can be reduced.

CITATION LIST

Patent Literature

Patent Literature 1: JP-A-5-166444

SUMMARY OF INVENTION

Technical Problem

In the relay controller described in Patent Literature 1, however, the regenerative current continues to flow to the coil via the diode even if the transistor is turned off to turn off the relay. Thus, it takes a time until the relay is rightly turned off.

The present invention is made in order to solve such an existing problem, and an object of the invention is to provide a relay controller which can shorten the time from turning off a switching element until turning off a relay compared with what is conventionally possible.

Solution to Problem

In order to achieve the object, the present invention comprises: a relay switch in which a contact point connects a power supply to a load, and a coil is connected to the power supply; a first switching element which is connected in series to the coil; a regenerative current circuit which is connected in parallel to the coil and includes a second switching element and a diode which is connected in series to the second switching element; a first switching element control unit which is adapted to turn on the relay switch by PWM control of the first switching element and to turn off the relay switch by stopping the PWM control of the first switching element; and a second switching element control unit which is adapted to turn on the second switching element when the first switching element is PWM-controlled and to turn off the second switching element when the PWM control of the first switching element is stopped.

ADVANTAGEOUS EFFECTS OF INVENTION

Since the present invention turns off the second switching element when the PWM control with respect to the first switching element is stopped, the regenerative current is prevented from flowing through the coil. Thus, the present invention can turn off the relay switch as soon as the PWM control with respect to the first switching element is stopped. Therefore, the time can be shortened from turning off the switching element until turning off the relay switch.

BRIEF DESCRIPTION OF DRAWINGS

FIG. 2 is a timing chart where a relay switch is to be turned on.

DESCRIPTION OF EMBODIMENTS

Figure 1:
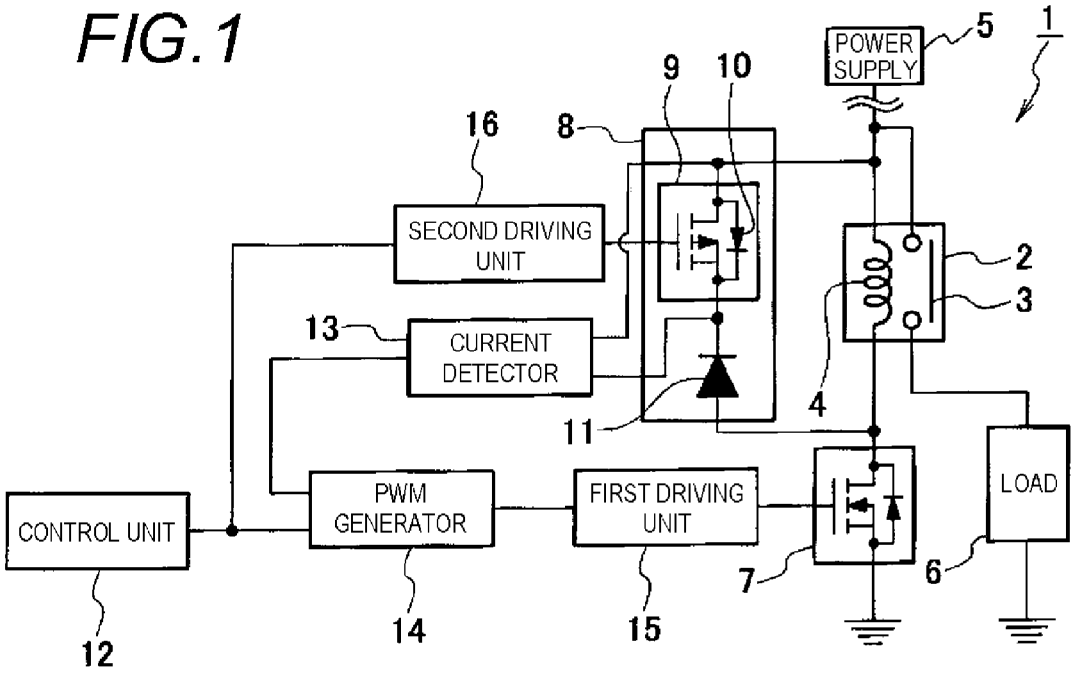
FIG. 1 is an explanatory diagram showing a relay controller according to an embodiment of the invention.

An embodiment of the invention is described with reference to the drawings. FIG. 1 is an explanatory diagram showing the configuration of a relay controller 1 according to the embodiment of the invention. The relay controller 1 includes a relay switch 2, a first MOSFET 7 (Metal Oxide Semiconductor Field Effect Transistor, also referred to as a first switching element 7), a regenerative current circuit 8, a control unit 12, a current detector 13, a PWM generator 14, a first driving unit 15 and a second driving unit 16. The relay controller is mounted in a vehicle.

The relay switch 2 includes a contact point 3 and a coil 4. The contact point 3 connects a power supply 5 to a load 6. The relay switch 2 is turned on and off by turning on and off the contact point 3. One end of the coil 4 is connected to the power supply 5, and the other end of the coil 4 is connected to the first switching element 7. The contact point 3 is turned on by flowing a current through the coil 4.

The power supply is a battery in the vehicle. The load 6 is an in-vehicle equipment mounted in the vehicle, such as a motor or a lamp.

The first switching element 7 is connected in series to the coil 4. Specifically, the drain of the switching element 7 is connected to the other end of the coil 4, the source is grounded, and the gate is connected to the first driving unit 15.

The regenerative current circuit 8 includes a second MOSFET 9 (also referred to as a second switching element 9) and a diode 11, and is connected in parallel to the coil 4. The drain of the second switching element 9 is connected to the power supply 5 and the one end of the coil, the source is connected to the cathode of the diode 11, and the gate is connected to the second driving unit 16. The anode of a body diode 10 of the second switching element 9 is connected to the power supply 5 and the one end of the coil 4, and the cathode is connected to the cathode of the diode 11. The anode of the diode 11 is connected to the other end of the coil 4 and the drain of the first switching element 7. The forward direction of the body diode 10 is opposite to the forward direction of the diode 11. Therefore, if the power supply is reversely connected, the switching elements are protected since the pass-through current (short-circuit current) does not flow through each of the switching elements. In the relay controller described in Patent Literature 1, on the contrary, if the power supply is reversely connected when the transistor is changed to the MOSFET, the short-circuit current flows through the MOSFET via the diode connected in parallel to the resistor and the coil or the body diode of the MOSFET, and the MOSFET is likely damaged. In this way, the relay controller 1 can firmly protect each of the switching elements better than usual.

The control unit 12 generates a relay-on signal for turning on the relay switch 2 or a relay-off signal for turning off the relay switch 2 in response to an instruction from the outside (for example, by an input operation by a passenger of the vehicle), and outputs the relay-on signal or the relay-off signal to the PWM generator 14 and the second driving unit 16.

The current detector 13 detects a value of a current, i.e., a regenerative current flowing through the second switching element 9. The regenerative current indicates a current flowing through the coil 4 when the first switching element 7 is off. The current detector 13 outputs a detection signal concerning the detected value to the PWM generator 14.

The PWM generator 14 alternately generates and outputs, to the first driving unit 15, a PWM-on signal for turning on the first switching element 7 and a PWM-off signal for turning off the first switching element 7 when the PWM generator 14 receives the relay-on signal from the control unit 12. The PWM generator 14 stop the output of the PWM-on signal and the PWM-off signal when the PWM generator 14 receives the relay-off signal from the control unit 12. The PWM generator adjusts the duty cycle of the PWM control on the basis of the detection signal received from the current detector 13. The duty cycle of the PWM control indicates a ratio of a time for outputting the PWM-on signal to a time for outputting the PWM-off signal.

The first driving unit 15 turns on the first switching element 7 when the PWM-on signal is received from the PWM generator 14, and turns off the first switching element 7 when the PWM-off signal is received from the PWM generator 14. In this way, the first driving unit 15 PWM-controls the first switching element 7. The relay switch 2 is turned on by the PWM control with respect to the first switching element 7, and turned off by stopping the PWM control with respect to the first switching element 7.

The second driving unit 16 turns on the second switching element 9 when received the relay-on signal from the control unit 12, and turns off the second switching element 9 when received the relay-off signal from the control unit 12.

Figure 2:
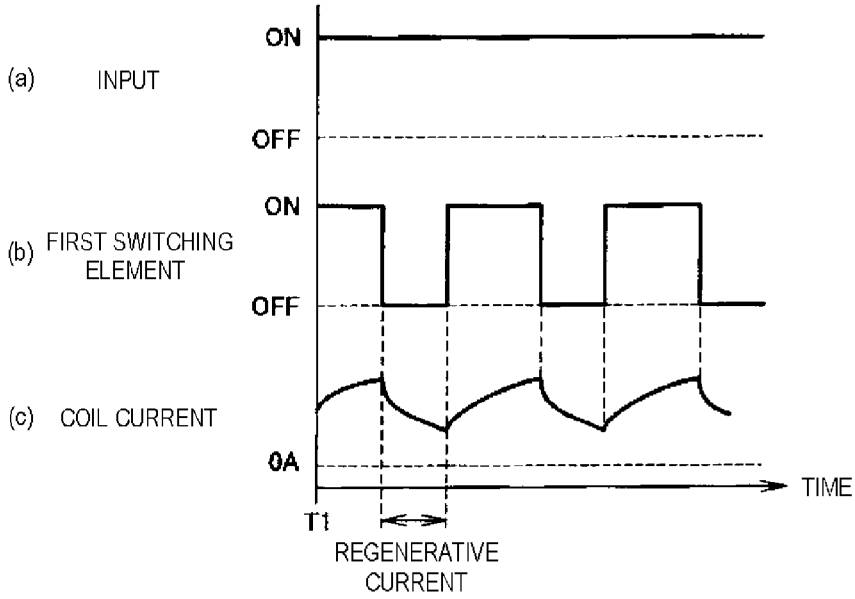
Figure 3:
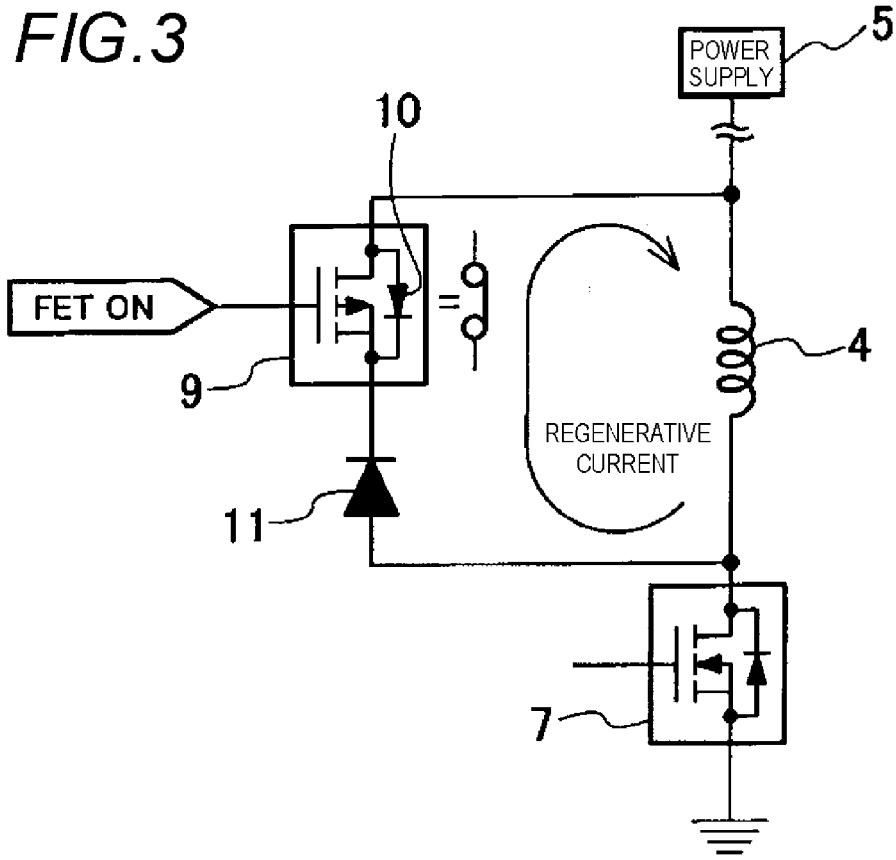
FIG. 3 is an explanatory diagram showing that a regenerative current flows.

Next, the operation of the relay controller 1 when the relay switch 2 is turned on is described with reference to FIG. 2 and FIG. 3. FIG. 2 is a timing chart where the relay switch 2 is turned on. Specifically, in FIG. 2, (*a*) shows the kind of the signal output from the control unit 12, (*b*) shows an on/off state of the first switching element, and (*c*) shows the current flowing through the coil 4. FIG. 3 is an explanatory diagram showing that the regenerative current flows.

The control unit 12 continues to output the relay-on signal to the PWM generator 14 and the second driving unit 16 from a time T1. Thus, the PWM generator 14 outputs the PWM-on signal and the PWM-off signal alternately to the first driving unit 15, and the first driving unit 15 PWM-controls the first switching element 7 on the basis of the signal given from the PWM generator 14. The second driving unit 16 turns on the second switching element 9.

Therefore, when the first switching element 7 is in an on-state, the downstream of the coil 4 is grounded and the current (also referred to as on-current) supplied from the power supply flows to the coil. The on-current increases as the time elapses. On the contrary, when the first switching element 7 is turned off, the downstream of the coil 4 becomes open and the regenerative current flows through the coil 4. The regenerative current decreases as the time elapses. The current flowing through the coil 4 continuously changes. For example, the on-current flowing at the time of finishing the on-state of the first switching element 7 is the same in magnitude as the regenerative current flowing at the time of starting the off-state of the first switching element 7. Thus, the current flowing through the coil 4 during the PWM control becomes minimum when the first switching element 7 is switched from the off-state to the on-state. Hereinafter, the current at this time is also referred to as a minimum current. The PWM generator 14 adjusts the duty cycle so that the value of the minimum current matches a target current value. The target current value indicates a minimum value required to turn on the relay switch 2. The description is made later in detail.

Figure 4:
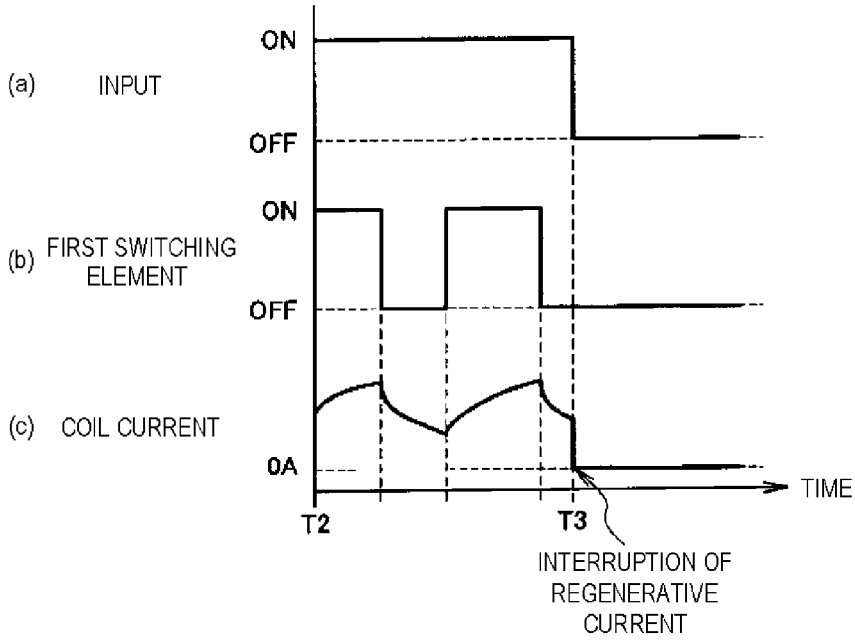
FIG. 4 is a timing chart where the relay switch is to be turned off.
Figure 5:
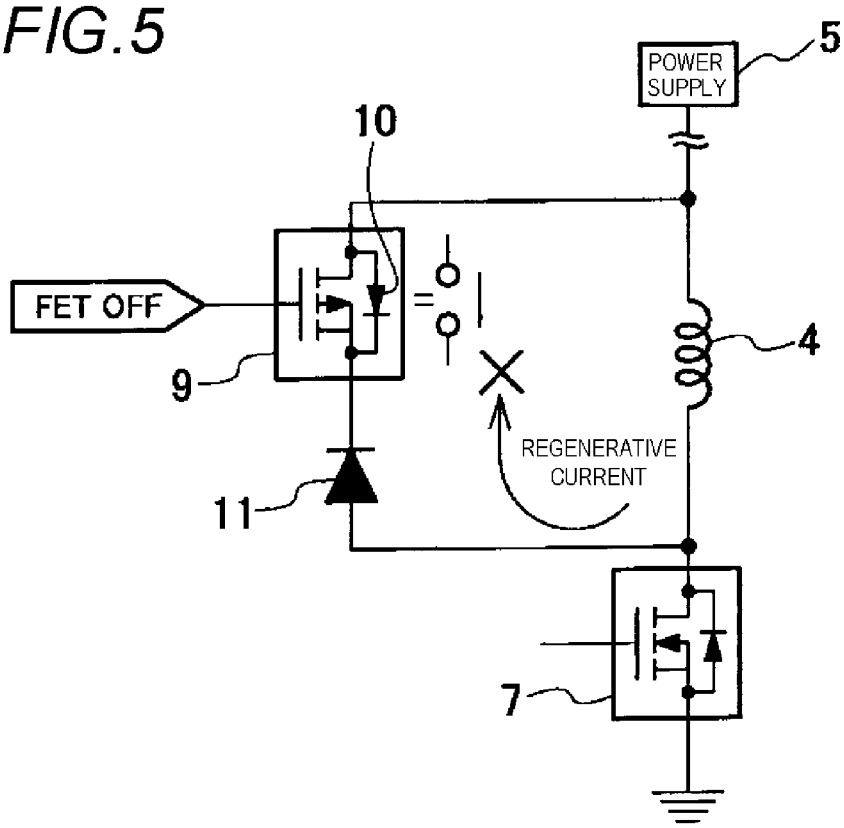
FIG. 5 is an explanatory diagram showing that the regenerative current is interrupted.

Next, the operation of the relay controller 1 when the relay switch 2 is turned off is described with reference to FIG. 4 and FIG. 5. FIG. 4 is a timing chart where the relay switch 2 is turned off. In FIG. 4, (*a*) shows the kind of the signal output from the control unit 12, (*b*) shows an on/off state of the first switching element, and (*c*) shows the current flowing through the coil 4. FIG. 5 is an explanatory diagram showing that the regenerative current is interrupted.

The controller 12 continues to output the relay on signal from a time T2 to a time T3, and then continues to output the relay-off signal to the PWM generator 14 and the second driving unit 16. Thus, the PWM generator 14 stops to output the PWM-on signal and the PWM-off signal at the time T3, and the first driving unit 15 stops to PWM-control the first switching element 7 to turn off the first switching element 7. The second driving unit 16 turns off the second switching element 9.

Therefore, the on-current to the coil 4 is interrupted. Further, since the second switching element 9 is turned off, the regenerative current does not flow through the coil 4. In this way, the relay switch 2 is turned off as soon as the relay-off signal is output from the control unit 12. Since the voltage from the power supply 5 and the induced voltage (a voltage which causes the regenerative current) from the coil 4 are applied to the first switching element 7 when the relay switch 2 is turned off, one which is tolerable to these voltages is used as the first switching element 7.

Figure 6:
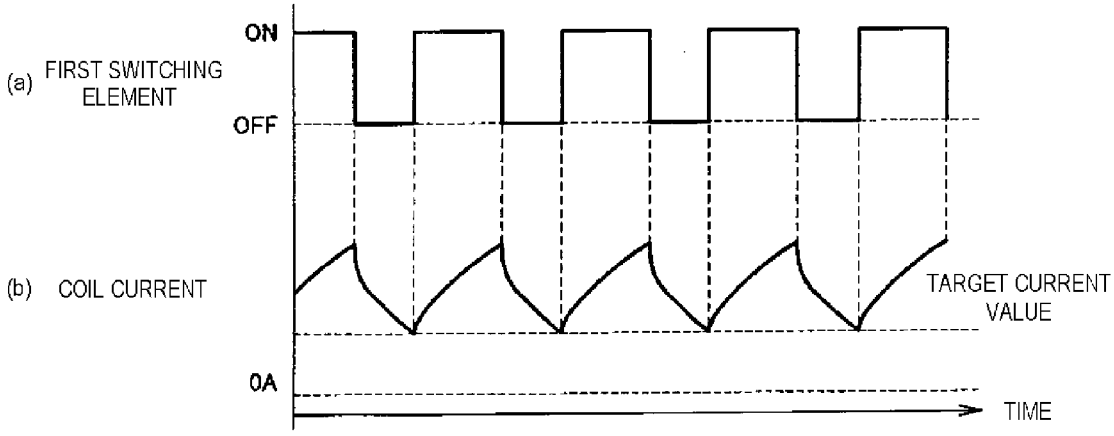
FIG. 6 is a timing chart where a PWM control is performed.

Next, setting of the target current value and adjustment of the duty cycle are described with reference to FIG. 6. In FIG. 6, (*a*) shows an on/off state of the first switching element, and (*b*) shows the current flowing through the coil 4 during the PWM control.

When the relay switch 2 is turned on in the on-state of the second switching element 9 and then the first switching element 1 is turned off, the regenerative current flows through the relay switch 2. Although the relay switch 2 is kept in the on-state due to the regenerative current, the regenerative current decreases as the time elapses, and then the relay switch 2 is turned off at a certain timing. Therefore, the value of the regenerative current just before the relay switch 2 is turned off should be the target current value.

Thus, the target current value is set as below. That is, the relay switch 2 is turned on in the on-state of the second switching element 9, and then the first switching element 7 is turned off. Then, the regenerative current is monitored by the current detector 13, whereas the on/off state of the relay switch 2 is monitored. Monitoring the on/off state of the relay switch 2 is performed by monitoring the voltage between the contact point 3 and the load 6. A value of the current detected by the current detector 13 just before the relay switch is turned on is set as the target current value. The target current value is stored in the PWM generator 14.

The target current value is a minimum value required to keep the relay switch 2 turned on. That is, if the current flowing through the coil 4 is equal to or larger than the target current value, the relay switch 2 is kept on the on-state. On the contrary, the current flowing through the coil 4 during the PWM control becomes minimum when the first switching element 7 is switched from the off-state to the on-state. Thus, the PWM generator 14 adjusts the duty cycle so that the current at this time, i.e., the value of the minimum current matches the target current value.

Since the relay controller described in Patent Literature 1 does not perform the control based on the target current value of the present embodiment, the current flowing through the coil of the relay becomes larger than that in the relay controller 1. Therefore, the relay controller 1 can reduce the heat generation and the consumption power of the coil 4 more than the conventional relay controller. Further, since the relay controller described in Patent Literature 1 detects the current flowing through the coil using the resistor, the heat generates from the resistor. Thus, the effect for reducing the heat generation for the overall relay controller is lowered. However, since the relay controller 1 does not use the resistor in detecting the current, such a problem does not arises. Thus, the relay controller 1 can reduce the heat generation for the overall device as compared with the conventional device.

Figure 7:
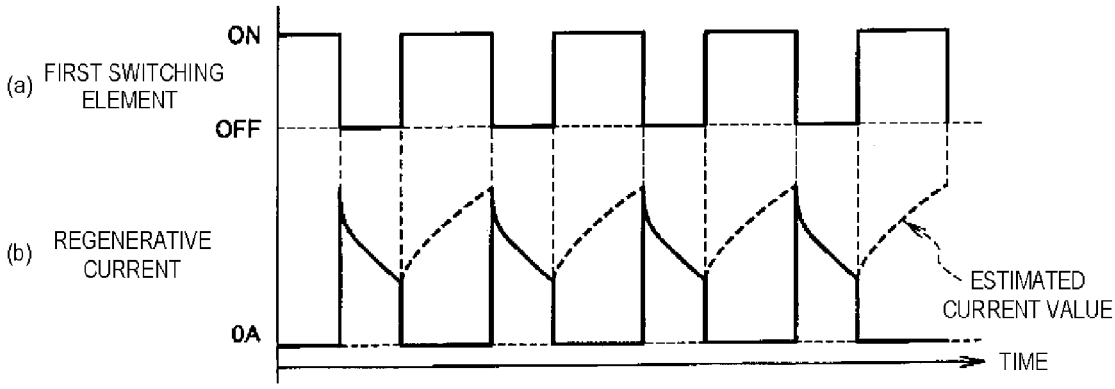
FIG. 7 is a timing chart where the PWM control is normally performed.
Figure 8:
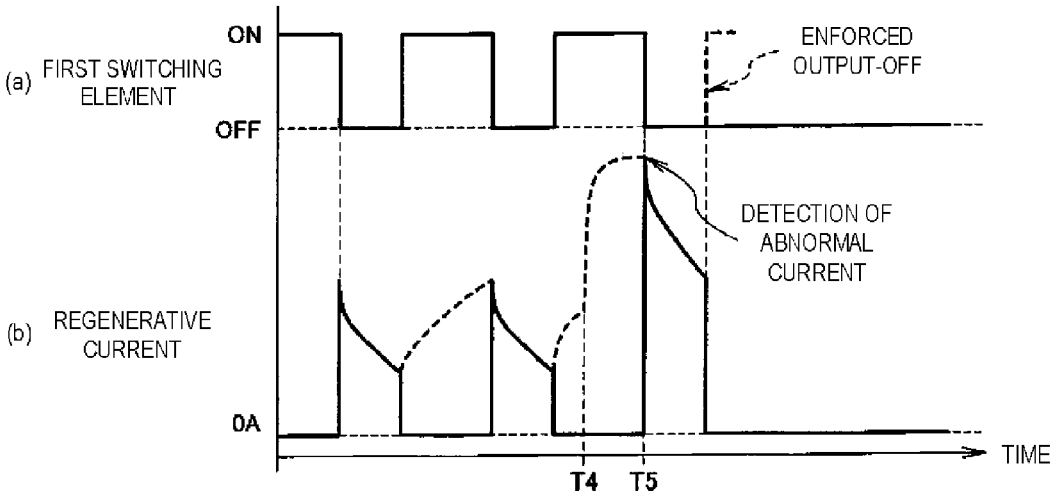
FIG. 8 is a timing chart where an abnormality arises during the PWM control.

Next, an abnormality determination is described with reference to FIG. 7 and FIG. 8. FIG. 7 is a timing chart where the PWM control is normally performed. FIG. 8 is a timing chart where an abnormality arises during the PWM control. Specifically, each (a) in FIG. 7 and FIG. 8 shows an on/off state of the first switching element, and each (b) in FIG. 7 and FIG. 8 shows the regenerative current flowing through the coil 4.

Since the current flowing through the coil 4 continuously changes, the regenerative current is detected, and the on-current can be estimated based on the regenerative current. For example, when the regenerative current changes as shown in FIG. 7, it can be estimated that the on-current changes as shown by broken lines. If any abnormality arises at a time T4, and the on-current becomes large, the value of the regenerative current becomes extremely large when the first switching element 7 is switched from the on-state to the off-state at a time T5. Thus, it can be estimated that the on-current is abnormal at the time.

Therefore, the PWM generator 14 compares the value of the generative current with a predetermined abnormal determination value based on the detection signal received from the current detector 13 when the first switching element 7 is switched from the on-state to the off-state. As a result, the PWM generator 14 determines that the on-current is abnormal when the value of the regenerative current is equal to or larger than the abnormal determination value, and stops to output the PWM-on signal and the PWM-off signal. In this way, the first driving unit 15 stops the PWM control with respect to the first switching element 7 to turn off the first switching element 7. Further, the PWM generator 14 outputs an abnormality occurrence signal to the second driving unit 16 via the control unit 12. The second driving unit 16 turns off the second switching element 9 when received the abnormality occurrence signal. Thus, the relay switch 2 is immediately turned off. On the other hand, if the value of the regenerative current is smaller than the abnormal determination value, the PWM generator 14 determines that the on-current is normal and continues to output the PWM-on signal and the PWM-off signal. For example, if the regenerative current changes as shown in FIG. 7, the PWM generator 14 determines that the on-current is normal, and continues to output the PWM-on signal and the PWM-off signal. On the other hand, if the abnormality arises on the on-current at the time T4, the PWM generator 14 determines that the on-current is abnormal based on the detection signal received from the current detector 13 at the time T5, and stops to output the PWM-on signal and the PWM-off signal. Further, the PWM generator 14 outputs the abnormality occurrence signal to the second driving unit 16. By doing so, the relay switch 2 is immediately turned off.

As mentioned above, in the relay controller 1, since the second switching element 9 is turned off when the PWM control with respect to the first switching element 7 is stopped, the relay switch 2 can be immediately turned off after the PWM control with respect to the first switching element 7 is stopped. Therefore, the relay controller 1 can shorten the time from turning off the switching element 7 until turning off the relay switch 2 compared with what is conventionally used.

Further, since the relay controller 1 is configured so that the forward direction of the body diode 10 is opposite to the forward direction of the diode 11, each of the switching elements can be protected.

Further, since the relay controller 1 adjusts the duty cycle so that the value of the minimum current matches the target current value, it is possible to reduce the heat generation and the power consumption of the coil 4 than the conventional art. As a result, since the power consumption of the power supply 5 is reduced, the fuel required for charging the power supply 5 is reduced and the load to the environment is lowered.

Further, since the relay controller 1 stops the PWM control when the value of the regenerative current is out of the abnormal determination value, each of the switching elements can be protected from this aspect.

Further, in the relay controller 1, since both the countermeasure against the reverse connection and the detection of the regenerative current are performed by a single element, i.e., by the second switching element 9, the manufacturing cost of the relay controller 1 can be reduced more than the case where those are performed by the separate elements.

Note that the present embodiment can be modified without departing from the scope of the spirit of the invention. For example, the first switching element 7 may be provided at an upstream side of the relay switch 2 (at a side close to the power supply 5), and the diode 11 may be provided at an upstream side of the second switching element 9. It is not necessary to configure the relay controller 1 be mounted on the vehicle.

INDUSTRIAL APPLICABILITY

According to the relay controller of the present invention, it is useful that the time can be shortened from turning off a switching element until turning off a relay compared with what is conventionally used.

REFERENCE SIGNS LIST

1: relay controller, 2: relay switch, 3: contact point, 4: coil, 5: power supply, 6: load, 7: first switching element, 8: regenerative current circuit, 9: second switching element, 10: body diode, 11: diode, 12: control unit, 13: current detector, 14: PWM generator, 15: first driving unit, 16: second driving unit

The invention claimed is:

1. A relay controller, comprising:

a relay switch in which a contact point connects a power supply to a load, and a coil is connected to the power supply;

a first switching element which is connected in series to the coil;

a regenerative current circuit which is connected in parallel to the coil and includes a second switching element and a diode which is connected in series to the second switching element;

a first switching element control unit which is adapted to turn on the relay switch by PWM control of the first switching element and to turn off the relay switch by stopping the PWM control of the first switching element; and a second switching element control unit which is adapted to turn on the second switching element when the first switching element is PWM-controlled and to turn off the second switching element when the PWM control of the first switching element is stopped.

2. The relay controller according to claim 1, wherein the second switching element is a body diode, the forward direction of which is opposite to the forward direction of the diode.

3. The relay controller according to claim 1, comprising a current detector which detects a value of the regenerative current flowing through the second switching element, wherein the first switching element control unit adjusts the duty cycle of the PWM control with respect to the first switching element so that a minimum value detected by the current detector matches a minimum value of the current required to keep turning on the relay switch.

4. The relay controller according to claim 3, wherein the first switching element control unit stops the PWM control with respect to the first switching element in a case where the value detected by the current detector is out of a predetermined abnormal determination value.

5. The relay controller according to claim 1, wherein the cathode of the diode is connected to the power supply.

6. The relay controller according to claim 1, wherein the anode of the diode is connected to the coil.

7. The relay controller according to claim 1, further comprising a current detector which detects a value of the current flowing through the second switching element, wherein the first switching element control unit stops the PWM control with respect to the first switching element in a case where the value detected by the current detector is out of a predetermined abnormal determination value.

8. The relay controller according to claim 1, wherein the first switching element is stopped in response to an abnormality being detected.

* * * * *